US007325275B2

(12) United States Patent
Nam et al.

(10) Patent No.: US 7,325,275 B2
(45) Date of Patent: Feb. 5, 2008

(54) CLEANER HAVING BRUSH HEIGHT CONTROL APPARATUS

(75) Inventors: Hyeun Sik Nam, Seoul (KR); Yong Woo Lee, Seoul (KR); Ho-Seon Rew, Seoul (KR); Choon Myun Chung, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 629 days.

(21) Appl. No.: 10/716,540

(22) Filed: Nov. 20, 2003

(65) Prior Publication Data

US 2004/0231095 A1 Nov. 25, 2004

(30) Foreign Application Priority Data

May 21, 2003 (KR) ..... 10-2003-0032364

(51) Int. Cl.
*A47L 5/00* (2006.01)

(52) U.S. Cl. ..... 15/372

(58) Field of Classification Search ..... None
See application file for complete search history.

(56) References Cited

U.S. PATENT DOCUMENTS 4,446,594 A 5/1984 Watanabe et al.
4,976,003 A 12/1990 Williams
5,477,587 A 12/1995 Glenn, III et al.

FOREIGN PATENT DOCUMENTS

| | | |
|---|---|---|
| DE | 4344596 | 6/1995 |
| GB | 1397916 | 6/1975 |
| JP | 2000-245668 | 12/2000 |
| WO | 01/41617 | 6/2001 |

OTHER PUBLICATIONS

English Language Abstract of DE 4344596.
English Language Abstract of JP 2000-245668.

*Primary Examiner*—David Redding
(74) *Attorney, Agent, or Firm*—Greenblum & Bernstein, P.L.C.

(57) ABSTRACT

A cleaner includes a suction motor mounted in a cleaner main body, and generating a suction force; a filter for collecting dust or filth sucked by the suction force generated at the suction motor; a suction head connected with the filter by a suction tube, and sucking dust and filth on a floor; a brush installed in the suction head so as to ascend/descend in a vertical direction, and sweeping dust and foreign substances into the suction head; and a brush height control apparatus installed in the suction head, and making the brush ascend/descend in a vertical direction. The cleaner having a brush height control apparatus can prevent deterioration of a suction force and improving cleaning performance by constantly maintaining a gap between the suction head and the floor.

11 Claims, 7 Drawing Sheets

CLEANER HAVING BRUSH HEIGHT CONTROL APPARATUS

BACKGROUND OF THE INVENTION

1. Field of the Invention

The present invention relates to a cleaner having a brush height control apparatus, and more particularly to a cleaner capable of cleaning a floor and a carpet by controlling a height of a brush.

2. Description of the Background Art

In general, a cleaner includes a suction motor mounted in a main body for generating a suction force; a filter disposed at a suction portion of the suction motor and collecting dust or filth sucked by the suction force generated at the suction motor; and a suction head formed at a lower portion of the main body for sucking dust or filth on a floor.

FIG. 1 is a partial sectional view showing a suction head for a cleaner according to the conventional art.

In a conventional suction head 102 includes a supporting wheel 104 and a driving wheel 106 are mounted at a lower portion of the suction head 102, a brush 108 rotatably installed at inside of the suction head 102 for sweeping dust and filth on the floor; and a height control apparatus for ascend/descend the brush 108 with/from the floor by controlling a height of the suction head 102.

The height control apparatus includes a control lever 112 movably mounted at a guide slot 110 formed at an upper surface of the suction head 102, and operated by a user; a groove forming member 114 connected with the control lever 112, thusly moved with the control lever 112, and having grooves 116, 118 and 120 having different heights at its lower surface respectively; an operating rod 124 connected with the supporting wheel 104 positioned at a lower portion of the suction head 102, and making the supporting wheel 104 ascend/descend by being inserted at one of the three grooves 116, 118 and 120.

Also, first and second links 126 and 128 are connected to one side of the supporting wheel 104 so as to support the supporting wheel 104.

The grooves 116, 118 and 120 are a first groove 116 having the lowest height; a second groove 118 having a medium height, and a third groove 120 having the highest height respectively. Also, a guide hole 130 in which the operating rod 124 is inserted for being supported is formed at the suction head 102 so that the rod may move in a vertical direction.

In the convention cleaner as above, when a user pushes the control lever 112 in an arrow P direction to change a mode of the cleaner into a carpet cleaning mode, an upper end of the operating rod 124 is inserted at the first groove 116, and thus the operating rod 124 is ascended. Due to this ascending, the supporting wheel 104 is ascended, and thus the height of the suction head 102 is lowered in whole. At this time, a height of the brush 108 mounted at the suction head 102 is also lowered, and the brush 109 comes in contact with a carpet. When the cleaner is driven in this state, the brush 108 sweeps dust and foreign substances stuck in the carpet into the suction head 102 while being rotated.

When a user pulls the control lever 112 in an arrow Q direction to change a mode of the cleaner into a floor cleaning mode, the groove forming member 114 is moved with the control lever 112, and thus the upper end of the operating rod 124 is inserted at the third groove 120. Then, the operating rod 124 and the supporting wheel 104 are descended together and thus lift the suction head 102. Then, the brush 108 mounted at the suction head 102 is also lifted, and so separated from the floor. When the cleaner is driven in this state, the brush 108 is not in contact with the floor for protects the floor, and dust and foreign substances on the floor are sucked by the suction force of the suction motor.

However, in the conventional cleaner as above, in the floor cleaning mode, since the suction head 102 is lifted in whole so that the brush 109 is not in contact with floor, a gap between the suction head 102 and the floor becomes greater. For this reason, suction force and cleaning performance is deteriorated.

SUMMARY OF THE INVENTION

In order to solve the problems of the conventional art stated above, an object of the present invention is to provide a cleaner having a brush height control apparatus capable of preventing deterioration of a suction force and improving cleaning performance by constantly maintaining a gap between a suction head and a floor by controlling only a height of the brush in the suction head.

To achieve these and other advantages and in accordance with the purpose of the present invention, as embodied and broadly described herein, there is provided a cleaner including a suction motor mounted in a cleaner main body and generating a suction force; a filter for collecting dust or filth sucked by the suction force generated at the suction motor; a suction head connected with the filter by a suction tube, and sucking dust and filth on the floor; a brush installed in the suction head so as to ascend/descend in a vertical direction, and sweeping dust and foreign substances into the suction head; and a brush height control apparatus installed in the suction head, and making the brush ascend/descend in a vertical direction.

The brush height control apparatus includes a sliding unit supporting so that the brush can be ascended/descended in a vertical direction while being rotated; a switching unit operated by a user in order to control the height of the brush; and an operation rod for transmitting an operating force of the switching unit to the sliding unit.

The sliding unit includes guide members mounted at an inner side surface of the suction head; a sliding member at which both ends of a hinge shaft prolonged from both end portions of the brush are rotatably inserted respectively, supported at the guide members so as to linearly move in a vertical direction; and an elastic member positioned at a lower surface of the sliding member, and providing a certain elastic force for pushing the sliding member upwardly.

The guide members are vertically erected at both sides of the inner surface of the suction head respectively, and have a sliding surface where the sliding member slides in a vertical direction.

A hinge shaft of the brush is inserted at center of the sliding member and rotatably supported, the operation rod is in contact with upper surface of the sliding member, the elastic member is supported at lower surface of the sliding member, and both side of the sliding member are in contact with the sliding surface of the guide member.

Rollers are mounted at the both side surfaces of the sliding member, and a guide rail where the rollers are contacted and rotated is formed at inner side surface of the guide member.

The operation rod includes a connection rod portion positioned in an axial direction of the brush; a push rod portion downwardly prolonged from both ends of the connection rod portion, and pushing the sliding member; and an elevating rod portion upwardly prolonged from the center of the connection rod portion, and being ascended/descended in a vertical direction according to an operation of a switching unit.

The switching unit includes a main body rotatably supported at a mounting hole formed at the suction head; a button portion formed at an upper portion of the main body, and exposed to the upper portion of the suction head so that a user can operate; and a cam portion formed at a lower surface of the main body, and having a plurality of grooves where the upper end of the elevating rod portion is inserted, having different heights respectively.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may exist a plurality of embodiments of a suction apparatus for a cleaner. Hereinafter, the most preferred embodiment will be described.

Figure 1:
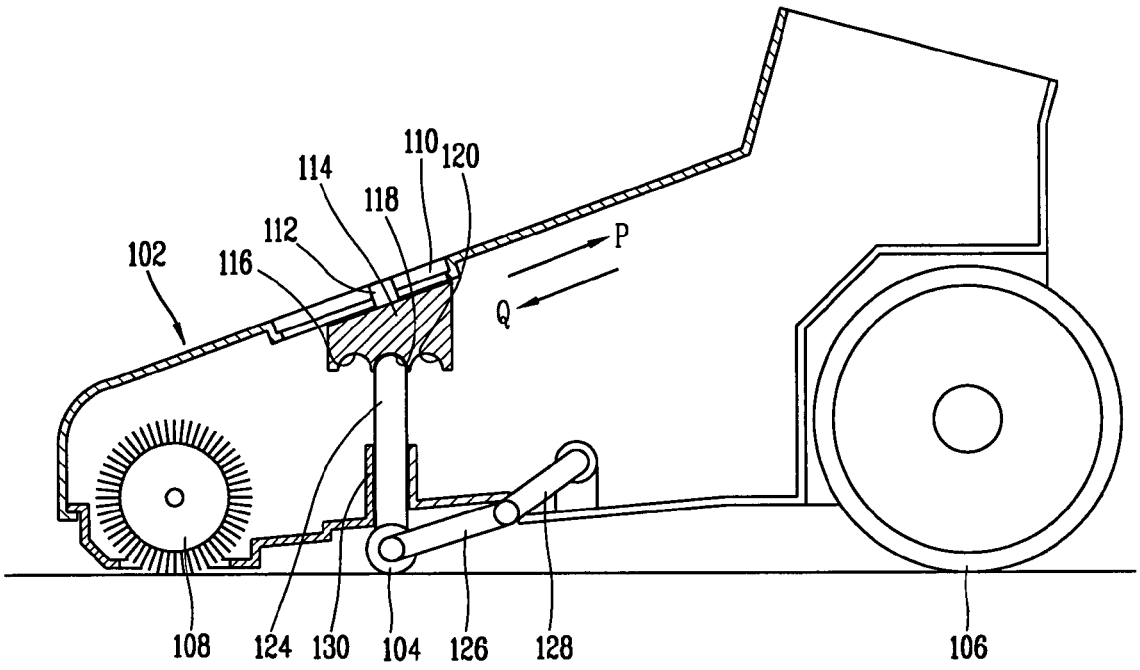
FIG. 1 BACKGROUND ART
FIG. 1 is a partial sectional view of a cleaner according to the conventional art.
Figure 2:
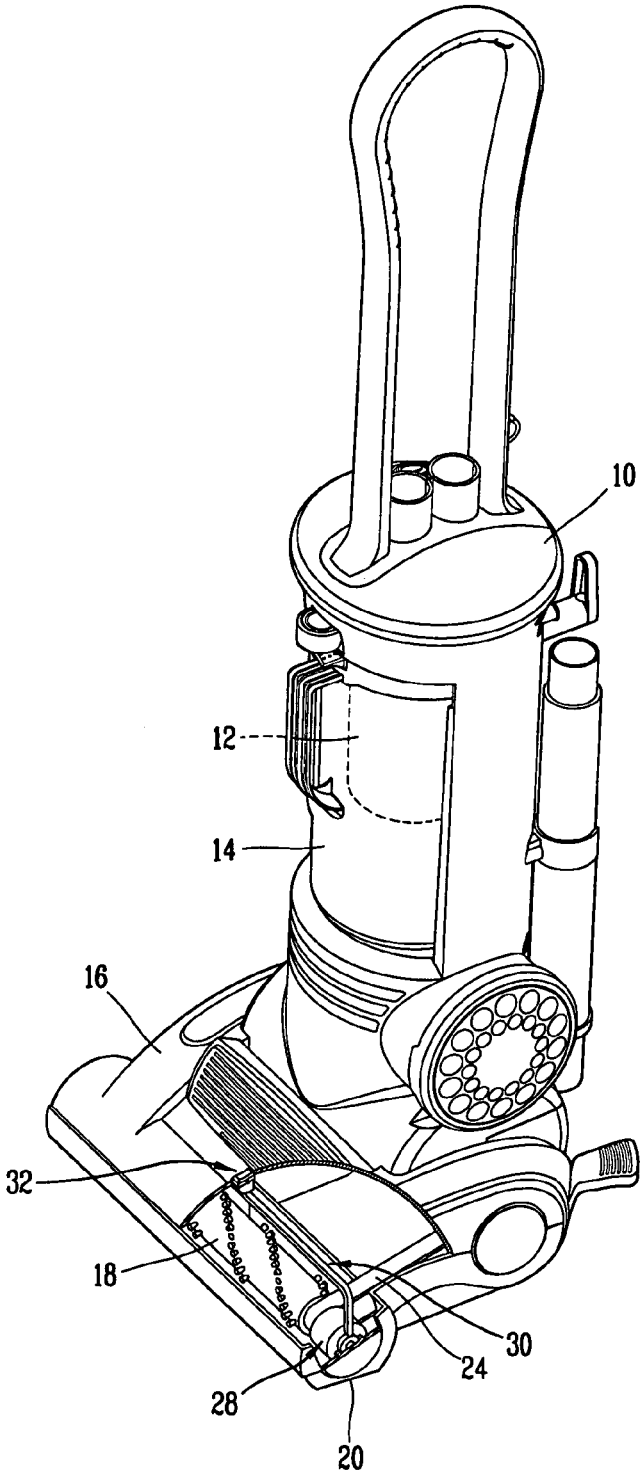
FIG. 2 is a partially dissected perspective view of a cleaner according to one embodiment of the present invention.
Figure 3:
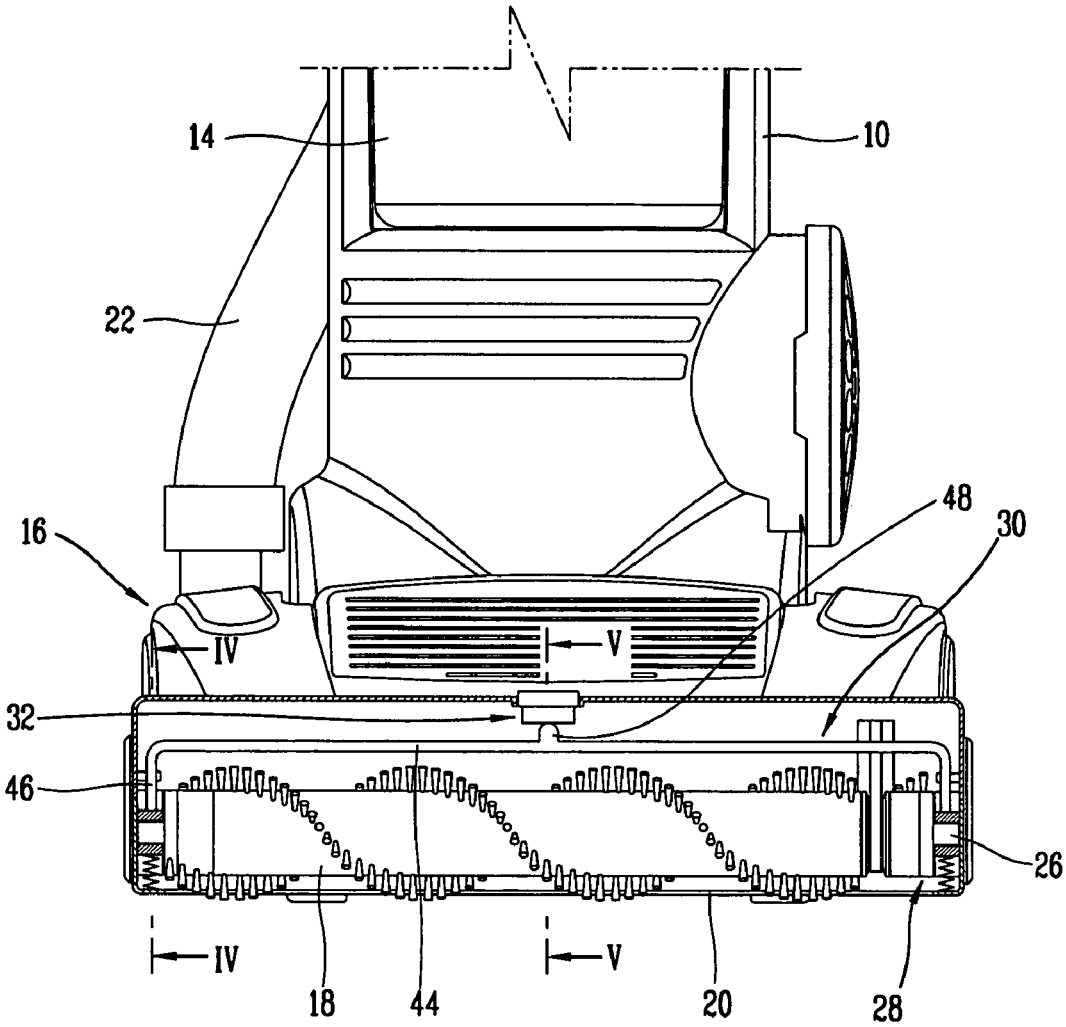
FIG. 3 is a sectional view of a cleaner according to one embodiment of the present invention.

FIG. 2 is a perspective view of a cleaner according to one embodiment of the present invention, and FIG. 3 is a sectional view of a cleaner according to the present invention.

The cleaner according to the present invention includes a cleaner main body 10 disposed in a state of being erected vertically; a suction motor (not shown) mounted in the cleaner main body 10, and generating a suction force; a filter 12 disposed in a suction area of the suction motor, and collecting dust or filth sucked by the suction force generated at the suction motor; a filter container 14 in which the filter 12 is mounted; a suction head 16 disposed at a lower portion of the cleaner main body 10, and sucking dust and filth on a floor; a brush 18 rotatably mounted in the suction head 16, and sweeping dust and filth on the floor into the suction head 16; and a brush height control apparatus for controlling a height of the brush 18.

As for the suction head 16, it has a certain space into which sucked dust and filth can be introduced, and a suction hole 20 into which dust and filth are sucked is formed at a lower side of the suction head 16. At one side thereof a suction tube 22 is connected to induce dust and filth sucked into the suction hole 20 to the filter 14.

The brush 18 is connected with the suction motor (not shown) by a belt 24, and sweeps dust and filth while being rotated by the rotating force generated at the suction motor.

The brush height control apparatus includes a sliding unit 28 rotatably supporting a hinge shaft 26 prolonged from both end portions of the brush 18, and also supporting the hinge shaft 26 so as to ascend/descend in a vertical direction; a switching unit 32 operated by a user in order to control the height of the brush 18; and an operation rod 30 for transmitting an operating force of the switching unit 32 to the sliding unit 28.

Figure 4:
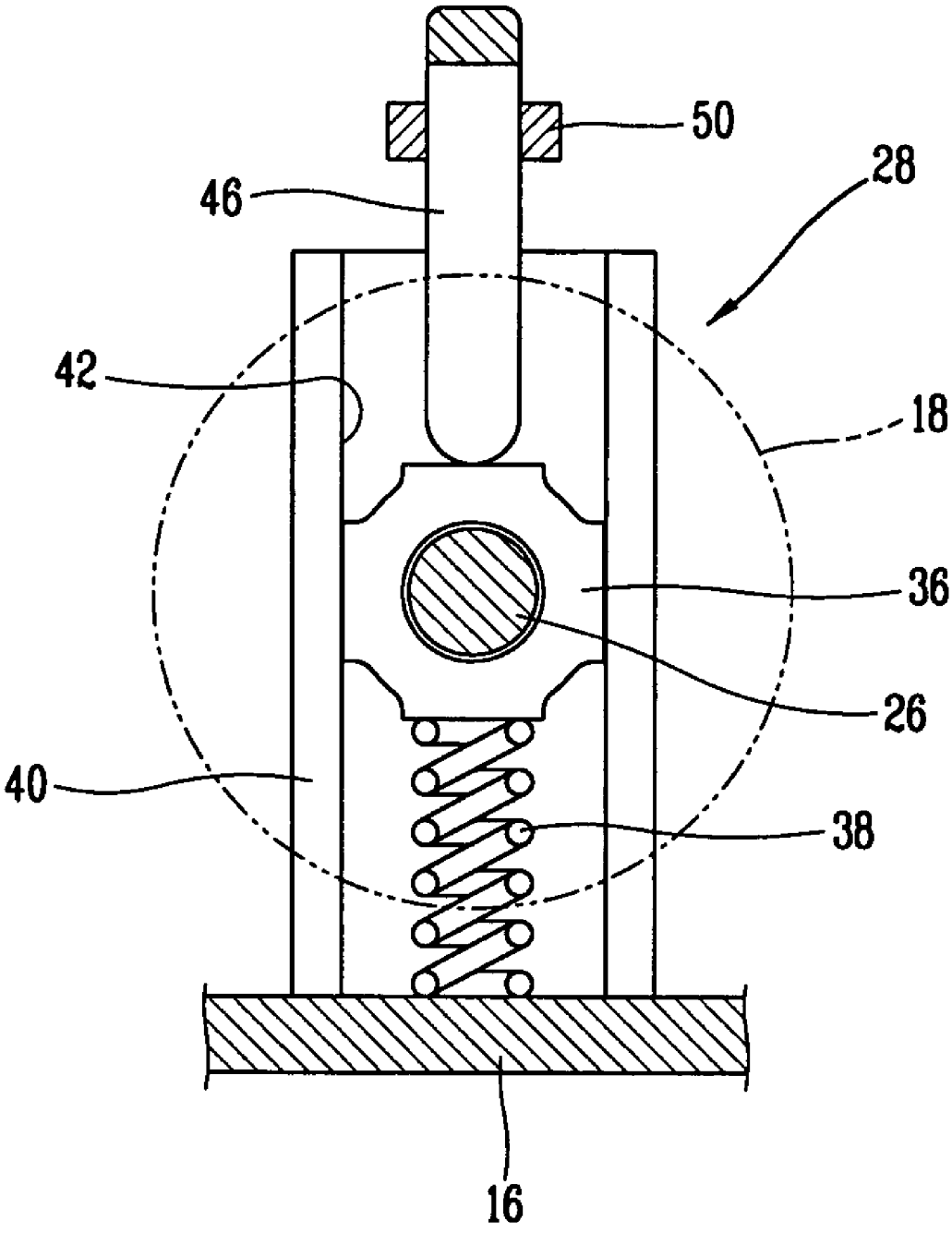
FIG. 4 is a section view taken along line IV-IV of FIG. 3.

As shown in FIG. 4, the sliding unit 28 includes a sliding member 36 at which both ends of the hinge shaft 26 of the brush 18 are rotatably inserted respectively, positioned at inner both sides of the suction head 16 so as to ascend/descend in a vertical direction; an elastic member 38 interposed between the lower surface of the sliding member 36 and the bottom of the suction head 16, and elastically supporting the sliding member 36; and guide members 40 formed at both inner side surfaces of the inner suction head respectively, and guiding so that the sliding member 36 can be linearly moved in a vertical direction.

Herein, in the sliding member 36, the hinge shaft 26 is rotatably supported at its center, and its upper surface is in contact with the operation rod 30 or is integrally connected with the operation rod 30. The elastic member 38 is supported at its lower surface, and its both side surfaces are in contact with the sliding surfaces 42 of the guide members 40.

Preferably, the elastic member 38 is interposed between the bottom of the suction head 16 and the lower surface of the sliding member 36, and is made of a coil spring having a certain elastic force for pushing the sliding member upwardly.

And, the guide members 40 are vertically erected at both inner side surfaces of the suction head 16, and have a sliding surface 42 with which the sliding member 36 is in contact so as to be linearly moved in a vertical direction.

The operation rod 30 includes a connection rod portion 44 positioned at a certain interval between itself and the brush 18 in an axial direction of the brush 18; a push rod portion 46 downwardly bent from the both ends of the connection rod portion 44, and pushing the sliding member 36; and an elevating rod portion 48 upwardly prolonged from the center of the connection rod portion 44, and being ascended/descended in a vertical direction according to an operation of the switching unit 32.

Herein, the push rod portion 46 is inserted at a supporting portion 50 formed at an inner side surface of the suction head 16 and supported so as to linearly move in a vertical direction.

Figure 5:
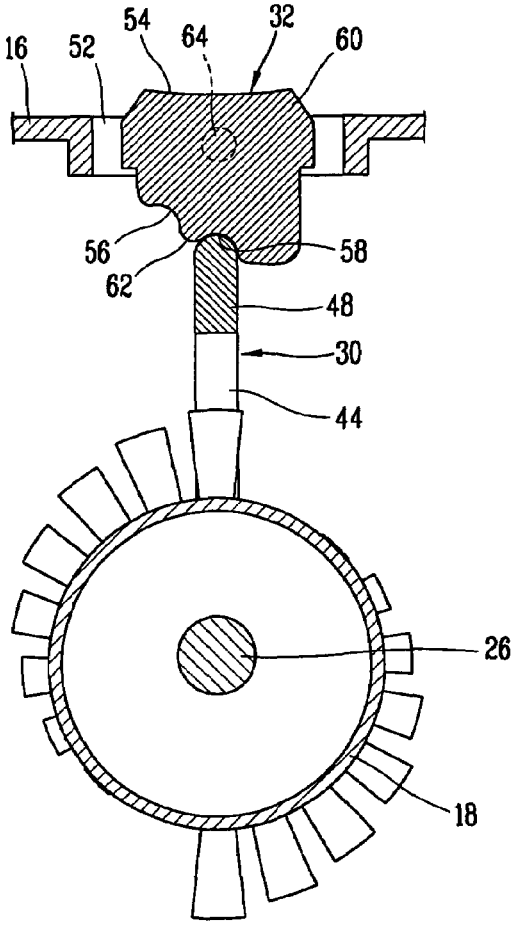
FIG. 5 is a sectional view taken along line V-V of FIG. 3.
Figure 6:
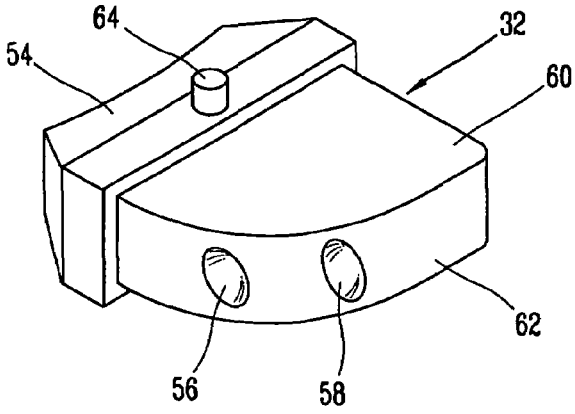
FIG. 6 is a perspective view of a switching operating unit according to one embodiment of the present invention.

As shown in FIGS. 5 and 6, the switching unit 32 includes a main body 60 rotatably supported at a mounting hole 52 formed at the upper surface of the suction head 16; a button portion 54 formed at an upper surface of the main body 60, exposed to the outside of the suction head 16 so that a user can operate; and a cam portion 62 having a plurality of grooves 56 and 58 having different heights respectively at which the elevating rod portion is inserted, formed at a lower surface of the main body.

A hinge protrusion 64 rotatably supported at the mounting hole 52 is prolonged from both sides of the main body 60. The cam portion 62 is roundly formed at a certain angle so as to be moved by coming in contact with the upper end of the elevating rod portion 48. At the cam portion 62, first and second grooves 56 and 58 are formed at a certain interval therebetween.

The height of the first groove 56 is formed to be low so as to move the elevating rod portion 48 downwardly when the elevating rod portion is inserted at the first groove 56. The height of the second groove 58 is formed to be relatively higher than that of the first groove so as to move the elevating rod portion 48 upwardly when the elevating rod portion is inserted at the second groove 58.

Herein, preferably, the upper end of the elevating rod portion 48 has a curved surface so as to easily move along the surface of the cam portion 62.

Operations of the brush height control apparatus for the cleaner according to the present invention constructed as above will now be described.

Figure 7:
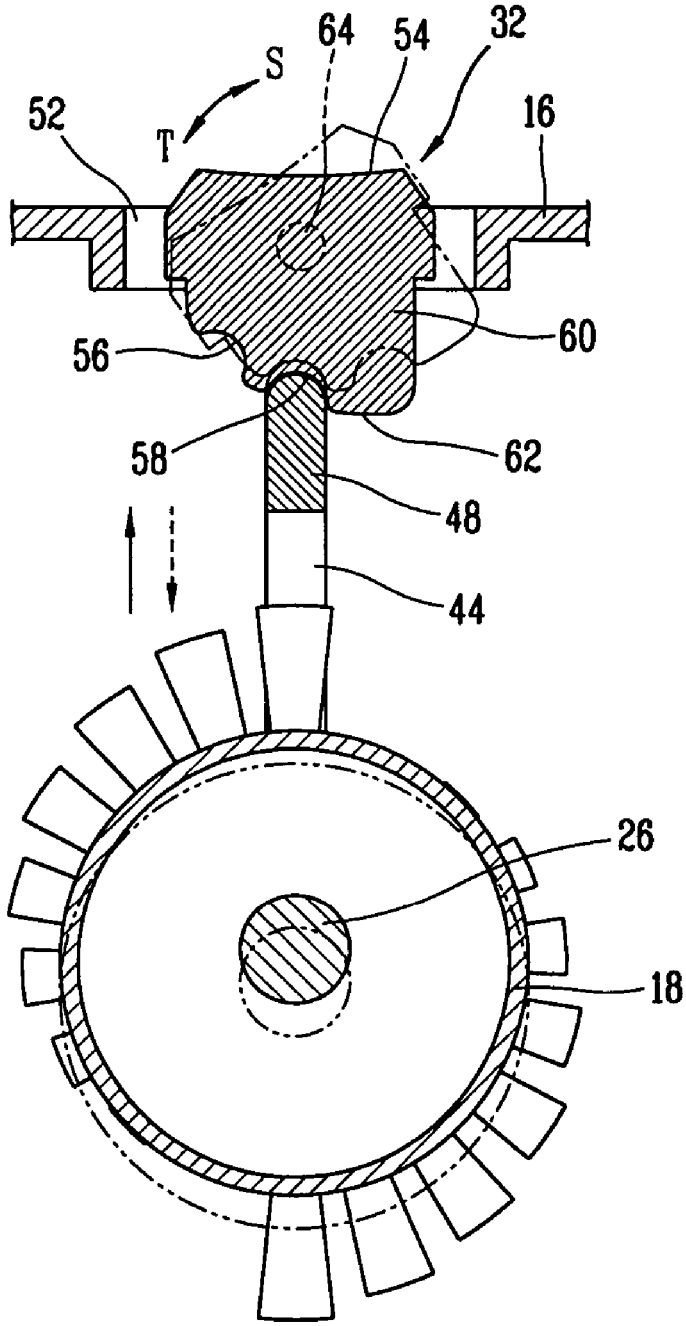
FIG. 7 is a state view showing an operation of a brush height control apparatus according to one embodiment of the present invention.

FIG. 7 is a state view showing an operation of a brush height control apparatus for a cleaner according to the present invention.

In case of cleaning a carpet, when a user presses the button portion 54 in an arrow S direction, the switching unit is rotated centering on a hinge protrusion, and thus the upper end of the elevating rod portion 48 is moved along the surface of the cam portion 62 and inserted at the second groove 58. When the upper end of the elevating rod portion 48 is inserted at the second groove 58, the operation rod 30 is descended. Then the push rod portion of the operation rod is descended too, and thus presses the sliding member. Due to the pressing, the sliding member overcomes an elastic force of the elastic member, and is linearly moved downwardly along the sliding surface of the guide member. Then, the brush rotatably supported at the sliding member is descended and thus comes in contact with the carpet. In this state, when the suction motor is driven, the brush sweeps dust and foreign substances of the carpet into the suction head while being rotated.

In case of cleansing a floor, when a user presses the button portion 54 in an arrow T direction, the switching unit is rotated, and thus the upper end of the elevating rod portion 48 is moved along the surface of the cam portion 62 and inserted at the first groove 58. When the upper end of the elevating rod portion is inserted at the first groove, the operation rod 30 is ascended, and the push rod portion of the operation rod is ascended too. Due to this ascending, the sliding member is moved upwardly by the elastic force of the elastic member, and accordingly, the brush rotatably supported at the sliding member is moved upwardly and separated from the floor. In this state, when the suction motor is driven, it can be prevented that the brush damages the floor by not being in contact with the floor. Dust and foreign substances are flowed into the suction head through the suction hole by the suction force generated at the suction motor, and then collected to the filter through the suction tube.

Figure 8:
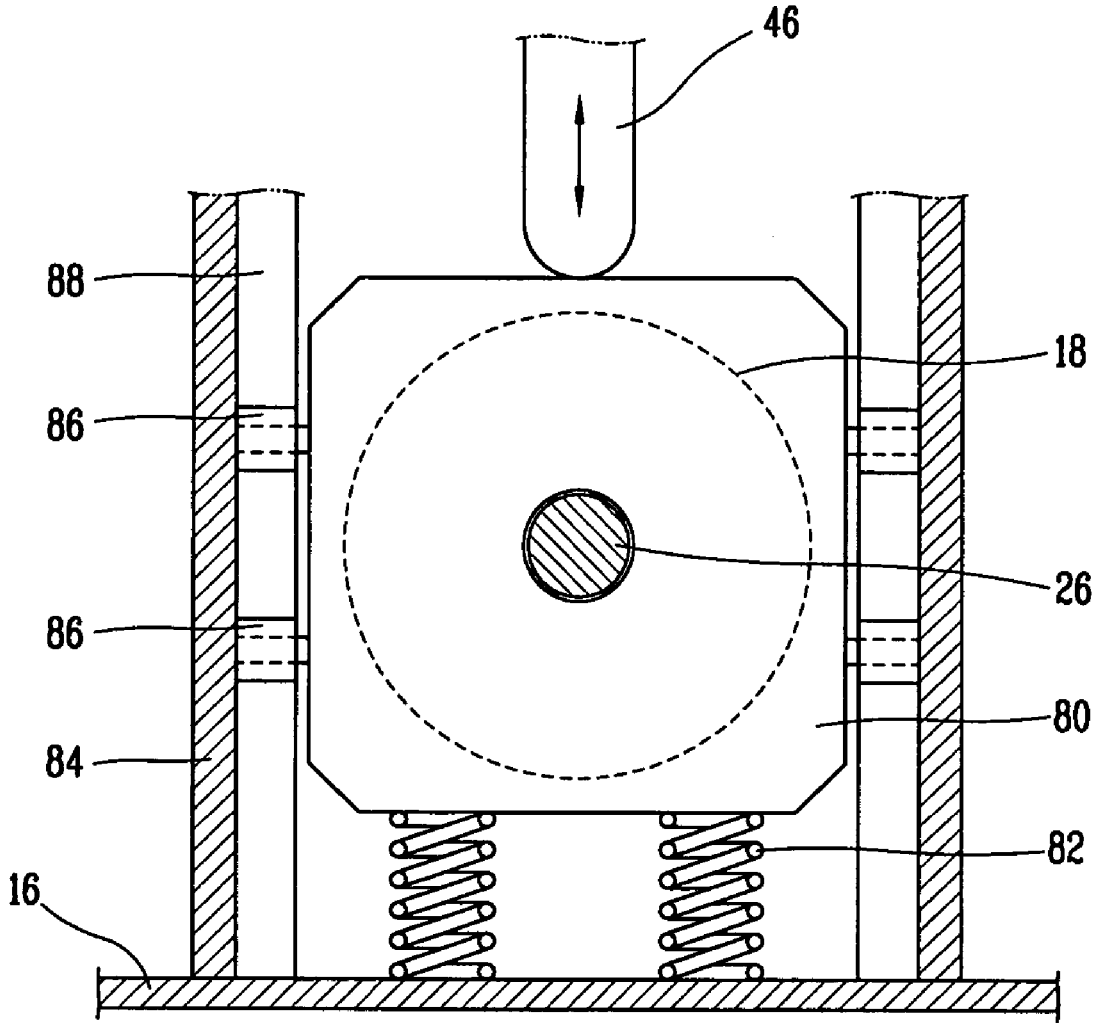
FIG. 8 is a sectional view of a hinge shaft supporting unit according to another embodiment of the present invention.

FIG. 8 is a partial sectional view showing a sliding unit according to another embodiment of the present invention.

The sliding unit according to another embodiment of the present invention includes a sliding member 80 at which both ends of the hinge shaft 26 of the brush 18 are rotatably inserted respectively, linearly moved in a vertical direction; an elastic member 82 interposed between a lower surface of the sliding member 80 and the bottom of the suction head 16, and elastically supporting the sliding member 80; and a guide member 84 vertically formed at the inside of the suction head 16, and guiding so that the sliding member 80 can be linearly moved in a vertical direction.

Herein, at both side surfaces of the sliding member 80, rollers 86 are mounted respectively. Also, a guide rail 88 is formed at an inner side surface of the guide member 84 in a longitudinal direction, and guides so that the sliding member 80 can be linearly moved in a vertical direction.

Effect of a suction apparatus for a cleaner according to the present invention constructed and operated as above, will now be described.

The brush is disposed in the suction head so as to linearly move in a vertical direction. So, when cleaning a carpet, the brush is linearly moved downwardly at the suction head and thus comes in contact with the carpet. When cleaning a floor, since the brush is moved upwardly at the suction head so as not to be in contact with the floor in order to protect the floor, a gap between the suction head and the floor can be constantly maintained. Accordingly, when cleaning the floor, deterioration of a suction force is prevented, and cleaning efficiency can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A cleaner comprises:

a suction motor mounted in a main body, and generating a suction force;

a filter that collects dust or filth sucked by the suction force generated at the suction motor;

a suction head connected with the filter by a suction tube, and sucking dust and filth on the floor;

a brush installed in the suction head so as to ascend/descend linearly in a generally vertical direction, and sweeping dust and foreign substances into the suction head; and a brush height control installed in the suction head, to cause the brush to ascend/descend linearly in a generally vertical direction, wherein the brush height control comprises:

a sliding unit that supports the brush so that the brush can ascend/descend linearly in a generally vertical direction while being rotated;

a switch operated by a user in order to control the height of the brush; and an operation rod that transmits an operating force of the switch to the sliding unit, and wherein the sliding unit comprises:

guide members mounted at an inner side surface of the suction head;

a sliding member at which both ends of a hinge shaft extending from both end portions of the brush are rotatably inserted respectively, supported at the guide member so as to linearly move in a vertical direction; and an elastic member positioned at a lower surface of the sliding member, and providing a certain elastic force that pushes the sliding member upwardly.

2. The cleaner of claim 1, wherein the guide members are vertically positioned at both sides of inner surface of the suction head respectively, and having a sliding surface where the sliding member slides in a vertical direction.

3. The cleaner of claim 1, wherein, a hinge shaft of the brush is inserted at center of the sliding member and rotatably supported, the operation rod is in contact with upper surface of the sliding member, the elastic member is supported at lower surface of the sliding member, and both sides of the sliding member are in contact with the sliding surface of the guide member.

4. The cleaner of claim 1, wherein the elastic member is a coil spring that elastically and upwardly supports the sliding member.

5. The cleaner of claim 1, wherein rollers are mounted at the both side surfaces of the sliding member, and a guide rail where the rollers are contacted and rotated, is formed at inner surface of the guide member.

6. The cleaner of claim 1, wherein the operation rod comprises:

a connection rod portion positioned in an axial direction of the brush;

a push rod portion downwardly extending from both ends of the connection rod portion, and pushing the sliding member; and an elevating rod portion upwardly extending from the center of the connection rod portion, and being ascended/descended in a vertical direction according to the operation of the switch.

7. The cleaner of claim 6, wherein the push rod portion is inserted in the guide portion formed in an inner side surface of the suction head, and supported so as to linearly move in a vertical direction.

8. The cleaner of claim 6, wherein the switch comprises;

a main body rotatably supported in a mounting hole formed at the suction head;

a button portion formed on an upper side of the main body, and exposed to the upper side of the suction head so that a user can operate; and a cam portion formed on a lower surface of the main body, and having a plurality of grooves having different heights respectively at which the upper end of the elevating rod portion is inserted.

9. The cleaner of claim 8, wherein hinge protrusions extend from both sides of the main body respectively, and are rotatably supported at a mounting hole of the suction head.

10. The cleaner of claim 8, wherein the grooves comprise:

a first groove having a low height so as to move the elevating rod portion downwardly when the elevating rod portion is inserted at the first groove; and a second groove having a relatively higher height than that of the first groove so as to move the elevating rod portion upwardly when the elevating rod portion is inserted at the second groove.

11. The cleaner of claim 8, wherein an upper end of the elevating rod portion at which the grooves are inserted, has a curved shape.

* * * * *